US005777537A

United States Patent [19]

Allen et al.

[11] Patent Number: 5,777,537

[45] Date of Patent: Jul. 7, 1998

[54] QUIET MAGNETIC STRUCTURES SUCH AS POWER TRANSFORMERS AND REACTORS

[75] Inventors: George M. Allen, Middle Grove; Harold F. O'Connor, Greenfield Center; Seymour Saslow, Saratoga Springs, all of N.Y.

[73] Assignee: Espey Mfg. & Electronics Corp., Saratoga Springs, N.Y.

[21] Appl. No.: 646,589

[22] Filed: May 8, 1996

[51] Int. Cl.[6] ..... H01F 27/24; H01F 27/26

[52] U.S. Cl. ..... 336/96; 336/210; 336/217

[58] Field of Search ..... 336/96, 210, 216, 336/217, 234

[56] References Cited

U.S. PATENT DOCUMENTS

| | | | |
|---|---|---|---|
| 1,406,245 | 7/1922 | Thordarson | 336/216 |
| 1,713,697 | 5/1929 | Granger | 336/216 |
| 3,007,124 | 10/1961 | Robinson . | |
| 3,102,246 | 8/1963 | Honey et al. . | |
| 3,125,735 | 3/1964 | Twomey . | |
| 3,316,515 | 4/1967 | Bock et al. . | |
| 3,683,303 | 8/1972 | Ayano et al. . | |
| 3,743,991 | 7/1973 | Gumpper et al. | 336/217 |
| 3,815,067 | 6/1974 | Koh . | |
| 3,895,336 | 7/1975 | Pitman | 336/219 |
| 4,047,138 | 9/1977 | Steigerwald . | |
| 4,055,826 | 10/1977 | Franz . | |
| 4,325,096 | 4/1982 | Sunohara et al. . | |
| 4,724,413 | 2/1988 | Kataoka . | |

OTHER PUBLICATIONS

"Transformer Core Constructions", K.C. Lin et al., Westinghouse ABB Power T & D Company, pp. 163–168, Intern'L Coil Winding Assoc., Inc., (Sep. 25–28, 1989).

*Primary Examiner*—Thomas J. Kozma
*Attorney, Agent, or Firm*—Weingram & Associates, P.C.

[57] ABSTRACT

A quiet transformer includes a laminated core having each laminate formed as a flat layer from highly grain oriented silicon steel which is fabricated by laser cutting techniques with each layer including five segments in intimate contact with each other via mitered butt lap joints having increased length and asymmetrical angles at opposite ends for reducing the reluctance of the gaps between adjacent lamination segments. The center segment has V joints of different angles on opposite ends. Clamping holes formed in the element of said lamination having the largest cross section at the location in the segment away from said gaps to prevent magnetic flux crowding and increased local flux density. Indexing pins on opposite faces of the segments close and lock in the gaps of the core with each layer being 100% interleaved for producing low joint reluctance and to minimize magnetostrictive forces. The core is pressurized by clamping brackets and bolts connected to opposite ends of the core. Leaf springs are connected between the brackets and the laminations for applying pressure to portions of the laminations.

3 Claims, 5 Drawing Sheets

QUIET MAGNETIC STRUCTURES SUCH AS POWER TRANSFORMERS AND REACTORS

BACKGROUND OF THE INVENTION

1. Field of the Invention

The present invention relates to methods and structures for extremely quiet transformers which may be made within existing size and weight constraints.

2. Description of the Prior Art

Noises emanating from magnetic structures when excited by an electrical current are caused by the movement of the magnetic medium in response to each alternating cycle of the applied voltage. This movement is transmitted to the surrounding air and is defined as airborne noise. It is also transmitted to the mounting means where it is termed as structure borne noise. The excitation coils or windings that carry the alternating currents contribute little noise to the surroundings. The sound emanating from such magnetic structures exhibit a wide frequency band often exceeding the normal range of human hearing.

Magnetostriction, a phenomena that takes place in a magnetic media causing dimensional change and movement, is dependant upon level of magnetization. Magnetostriction is the major contributor to noise. The present invention minimizes the magnetostrictive forces in the magnetic paths so as to achieve a "quiet magnetic structure".

Several prior art patents discuss controls and limitation of transformer noise. These patents are described below.

U.S. Pat. No. 3,007,124 to Robinson discusses reduction of noise caused by vibrations in a magnetic structure core. The noise reductions are occasioned by the use of a laminated magnetic core structure where the laminations are held together by non-short-circuiting bands along the legs of the rectangular core. Further, the laminations are supported at the nodal points of one phase of the magnetic structure and are "lightly" clamped through a framework. Alternative methods of supporting the lower end of the transformer core are shown in the FIG. 1–2, 3, and 4. It is described that the pinning required is to be inserted in the laminations and may be small because the laminations are held together by the bands.

U.S. Pat. No. 3,102,246 to Honey et al relates to a large power transformer located in suburban locations on electric power lines. A liquid dielectric is proposed in tubes with means to change the pressure in the liquid. The tubes serve to dampen the vibratory energy in the oil.

U.S. Pat. No. 3,125,735 to Twomey relies on specific mounting structure in an enclosure to limit the vibrations to the enclosure from a large electrical power distribution transformer.

U.S. Pat. No. 3,316,515 to Bock, et al discloses a magnetic structure separated by spacers such as 36, 38 and 40. Lock plates 42 and 44 are disposed along the length of each of the legs of the transformer adjacent to and contacting the outer laminations of each stack. Each stack of laminations has an opening through the stack so that a nut and bolt can be inserted between the elements of the stack and the supporting structure. The spacer is designed with a dimension which will decrease when the clamping force is applied thereto. The spacer does not change the gap spacing. The specific spacer design is shown in FIGS. 2 and 3.

U.S. Pat. No. 3,683,303 to Avano, et al encases the core and coil elements in a mixture of unsaturated polyester and a polyurethane. This relates to fluorescent lamps and to reduction or elimination of the transformer hum from the ballasts in fluorescent lights.

U.S. Pat. No. 3,815,067 to Koh produces a structure of a laminate in the shape of a U. In the space defined by the U Koh mounts a shock absorbent pad form and other laminates 5 and 7 which have surrounded by coil 6. The structure eliminates and reduces vibration and noise.

U.S. Pat. No. 4,047,138 to Steigerwald quiets the transformer by establishing radial air gaps at both ends of a ferrite magnetic core structure which includes rectangular outer members having aligned circular apertures. The patent relies on controlling the flux pattern and specifically the infringing flux pattern to reduce heat and vibrations.

U.S. Pat. No. 4,055,826 to Franz shows a high current reactor in which the current carrying windings are resiliently supported on a magnetic core. The windings are mounted on a series of springs.

U.S. Pat. No. 4,724,413 to Kataoka relies for noise suppression on sound-proof envelope 20 surrounding the primary winding of transformer 21. The sound-proof envelope is made of sound absorbing material such as silicone rubber or sound reflecting material such as metallic coil.

The article by Lin and Zook, TRANSFORMER CORE CONSTRUCTIONS, published in 1989 *Coil Winding Proceedings*, (Sep. 25–28, 1989) by International Coil Winding Association, Inc. pages 163–168 discusses available transformer core configurations.

SUMMARY OF THE INVENTION

The present invention incorporates a number of features to produce low noise magnetic structures.

One factor that affects the level of magnetostriction is the forces applied to the laminates of the magnetic structure and its insulating coating. These forces determine the stress condition of the surface.

The choice of a low operating flux density commensurate with other design restrictions is essential for quiet designs. Higher flux levels generate more noise. The flux distribution however is not uniform throughout the magnetic paths and high reluctance air gaps give rise to increased noise levels.

The magnetic properties of highly grain oriented silicon steels are desirable for these applications. Though known in the art, the present invention provides a practical way to take advantage of these materials. Core design methods require some opening in the basic core frame to allow wound coils to be inserted. A review of some common core designs indicate some of their disadvantages. Wound "C" and "E" types have butt joints that are cut in places yielding high reluctance. Stamped or cut lamination such as "E" and "I" shapes have joints in every layer. Their legs or yokes do not have the grain of the steel in the desired orientation and have an uncontrollable gap structure. The so called take apart cores, uncut wound cores, strip cut cores, etc., all suffer from high reluctance gaps or material strains that cannot be removed by heat treatment or annealing.

Grain oriented electrical steels are magnetic materials that exhibit superior magnetic properties in the direction of rolling. These steels are specially processed to create a high proportion of grains within the steel which have atomic crystalline structures similarly oriented relative to the rolling direction.

In silicon iron alloys, the atomic structure is cubic and the crystals are most easily magnetized in a direction parallel to the cubic edges. By combining the precise composition of the alloy and rigidly controlled rolling and heat treating procedures, the crystals are aligned with their cube edges nearly parallel to the rolling direction. As a result, they have superior permeability, low magnetostriction and lower core loss when magnetized in that direction. Drastic reductions in performance are noted when the flux path is only a few degrees from optimum.

At high inductions, low noise levels are difficult to achieve even with the best core materials due mainly to the material's strain sensitivity. Magnetostriction is particularly sensitive to strain, since it is a phenomena of stress resulting in microstrains. The surface coating of the steel can put the surface under tension resulting in a simpler closure domain pattern at the surface. This, in turn, substantially reduces magnetostriction. Externally applied tensile stress can then further improve the magnetostrictive strain many fold. Meticulous fabrication of very flat lamination which is less subject to strain during assembly, is necessary to control the micro strains.

To maximize the advantage of grain orientation in stamped or cut lamination, the various pieces of the lamination that make up the magnetic paths are configured so that the grain direction coincides with the flux path. The gaps between laminations cause the magnetic flux to travel around them thereby increasing the local flux density and the magnetostrictive forces.

The use of a mitered butt lap joint lamination structure reduces the reluctance of the gaps between adjacent lamination segments by increasing the length of the gap. The conventional mitered joint is at a 45 degree angle at the corners with a small offset to provide for overlap of successive lamination.

To further reduce the magnetic path reluctance, the miter joints are further increased in length and have asymmetrical angles at opposite sides of the lamination strip. This provides a more effective over lap by successive laminations. Similarly, the center leg of the core uses V joints of different angles on opposite ends. In all cases, the lamination is cut out so that all gaps have long length, presenting a larger cross sectional area, thereby reducing the flux density at the gaps. This is essential in the reduction of the magnetostrictive forces the cause of noise.

Further, to gain full advantage of the configuration, the lamination must be accurately cut to dimension, be free of burrs, and be perfectly flat. The clamping holes have to be located in a section of the lamination of largest cross section and away from the gaps to prevent magnetic flux crowding which increases the local flux density. Indexing pins on opposite faces of the lamination plates provide a means for closing and locking in the gaps of the assembly. The interleave of 100% provides for the lowest joint reluctance and minimum magnetostrictive forces.

This configuration also takes maximum advantage of minimizing the core loss in the magnetic structure by providing flux paths parallel to the grain direction. As compared to a conventual configuration, core losses may be reduced by a factor of as much as 3 to 1. This allows the designer to optimize the configuration by trading off loss distribution between copper and core. By using lower flux densities requiring more copper turns of smaller size than in a conventional design, the designer can achieve the same transformer profile within the same volume. This results in lower magnetostrictive forces and less noise.

The laminated assembly must also be handled with care so as not to apply excessive stresses to the core. The mounting hardware applies controllable pressure to the core assembly. Rigid precision clamping brackets are needed to control the actual pressure on the lamination. By means of insulated, high strength clamping bolts, the surface pressure can be adjusted to yield minimum magnetostriction. To apply optimum pressure to the laminated sections under the coil windings, selected leaf springs are wedged between the core tubes and the laminations. After the assembly has been completed and tested, it is prepared for impregnation. A suitable resin is injected into the assembly by means of vacuum pressure and cured. This helps to lock everything into place and provide the necessary insulating and thermal enhancement for the quiet product.

Aside from air borne noise which can be contained in part by air baffling means, the problem of structure borne noise is also recognized. The noise is transmitted through the mounting means of the transformer. To obtain very low levels of air borne noise, structure borne noise must also be reduced to a very low level; otherwise, the mounting frame, cabinet or structure will reradiate the structure borne noise as air borne noise defeating the air baffling, insulation, etc. In some cases rubber isolators can be used to reduce the noise transmitted through the mounting means.

In sea water applications aboard ships or submarines the noise is conducted to the hull of the ship and thereby to the surrounding water. In covert applications, this noise can be readily detected by listening devices that can pinpoint the location and identification of the vessel. The methods and techniques of the present invention result in extremely quiet magnetic structures for all applications where structure born noise is undesirable.

The quiet transformer of the present invention employs a stacked core of thin flat cuts of steel known as ARMCO MT, 11 mils thickness similar steel is available in the range of 6 to 14 mils thick. This steel is known to have extremely high grain orientation. The steel is milled so that it produces low loss and low magnetostriction in a magnetic field. The steel is rolled in one direction so that the grains are all oriented in one direction. This yields the greatest permeability lowest loss, and lowest noise in that direction. The favorable magnetic properties of this steel material are adversely impacted by denting, bending, pressure and cutting to form sharp ends.

When used in a flat laminated transformer core, the steel has an organic coating on each lamination to insulate one lamination from another to reduce losses from conductivity from lamination to lamination. This insulation on the surface of each lamination in the present invention is a first layer fired on by the basic oxidation process during heat treating of the steel and the second being a glass-like material to stiffen the exterior surface of the steel. The stiffening of the exterior surface locks the grains on the surface into position. This minimizes problems in the material by bending and sharp cutting.

Laminated transformer cores of the prior art are formed by cutting the material to size in a slitter or a die and then stacking each layer one on top of the other. The use of the slitter produces a cut which has poorer magnetic properties that the other portions of the lamination because the slitter tends to bend the material and the cut leaving a notch. The effects of these notches also known as burrs is an increase in transformer noise.

We have also discovered that the material we select is sensitive to pressure. The magnetostriction of the material is controlled and minimized by pressure applied to the laminar core. This control is achieved by making each part with minimal gaps, and with strong adjustable clamping. It is well known that flux density increases dramatically in the presence of gaps. The present invention takes the basic properties of the material and finely tunes the transformer to take advantage of the low noise properties of the material. Each aspect of our invention enhances, not destroys the noise limitation capabilities of the material. One of the aspects of the invention is that all dimensions of core laminations are within very close tolerances. Holes are formed in each of the laminations which are then clamped in place with fixtures for alignment.

The present invention recognizes that the curve of magnetostrictive energy to noise is responsive to the pressure on the material.

The gap surface is made longer in two pieces. This is approximately 30%–40% longer that conventional joints. The increased length inhibits the flux that tends to jump form one lamination to the other because it has a much wider path to traverse. The adjacent flux density is lower in the vicinity of the gap. The noise level is also reduced.

In order to achieve the required configuration, laser cutting techniques are employed. The laser cutting technique does not destroy the properties of the steel and yields the accurate desired shapes. The laser accomplishes these results because it does not produce any metal deformation.

We have found that the transformers made in accordance with our invention eliminate the need for baffles, sound insulation and separators.

The individual pieces are cut by laser. The transformer includes a stack of laminations which is clamped in place by brackets, pins and rods. The middle of the stack of laminations is controlled by a spring to produce at the middle of the stack, the same pressure as is applied on the ends of the stack. This pressure equalization across the stack is such that the laminate is at its point of zero magnetostriction. This reduces the noise output of the middle of the legs.

The stack is formed by reversing each element in a lamination from lamination to lamination. Each layer is 100% interleaved.

Noise measurements detect structure borne noise with a transducer connected to the unit. Airborne noise is measured by mounting a detector a given distance from the unit.

It is therefor a principal object and advantage of our invention to produce a quiet transformer. A still further object and advantage of our invention is the provision of a quiet transformer which minimizes magnetostriction of the transformer core. Another object and advantage of our invention is the provision of a quiet transformer which takes advantage of the magnetic properties of highly grain oriented silicon steels. A still further object and advantage of our invention is the provision of a quiet transformer which uses mitered butt lap joints. Another object and advantage of the invention is the provision of a quiet transformer with has long gap lengths at the mitered butt joints.

A still further object and advantage of the invention is the provision of a quiet transformer having asymmetrical angles at opposite ends of a lamination strip to further increase the length of the mitered butt joints. Another object and advantage of the invention is the provision of a quiet transformer having a center leg of the core which uses V joints of different angles on opposite ends. A still further object and advantage of the invention is the provision of a quiet transformer where each lamination is cut out so that all gaps have long length. Another object and advantage of the invention is the provision of a quiet transformer having gaps which have a large cross sectional area to reduce the flux density at the gaps. An important object and advantage of the invention is the provision of a quiet transformer where the lamination is cut using laser cutting techniques. A further object and advantage of the invention is the provision of a quiet transformer which has clamping holes located in a section of the lamination of largest cross section and away from the gaps to prevent magnetic flux crowding which increases the local flux density.

Another object and advantage of the invention is the provision of a quiet transformer using index pins on opposite faces of the lamination plates for closing and locking in the gaps of the assembly. A still further object and advantage of the invention is the provision of a quiet transformer where each lamination layer is interleaved 100% to provide for the lowest joint reluctance and reduction of magnetostrictive forces. Another object and advantage of the invention is the provision of a quiet transformer which core loss is minimized by providing flux paths parallel to the grain direction. A still further object and advantage of the invention is the provision of a quiet transformer where the surface pressure on the core is adjusted to yield minimum magnetostriction. Another object and advantage of the invention is the use of leaf springs to apply optimum pressure to laminated sections under the coil windings.

Another object and advantage of the invention is the provision of a quiet transformer which is impregnated with resin. A still further object and advantage of the present invention is the provision of a quiet transformer which does not require mechanical noise inhibitors such as rubber isolators and baffling.

BRIEF DESCRIPTION OF THR DRAWINGS

The foregoing as well as other objects, features and advantages of the invention will be apparent from the following description of the preferred embodiments thereof as illustrated in the accompanying figures of the drawings in which.

DESCRIPTION OF THE PREFERRED EMBODIMENTS

Figure 1:
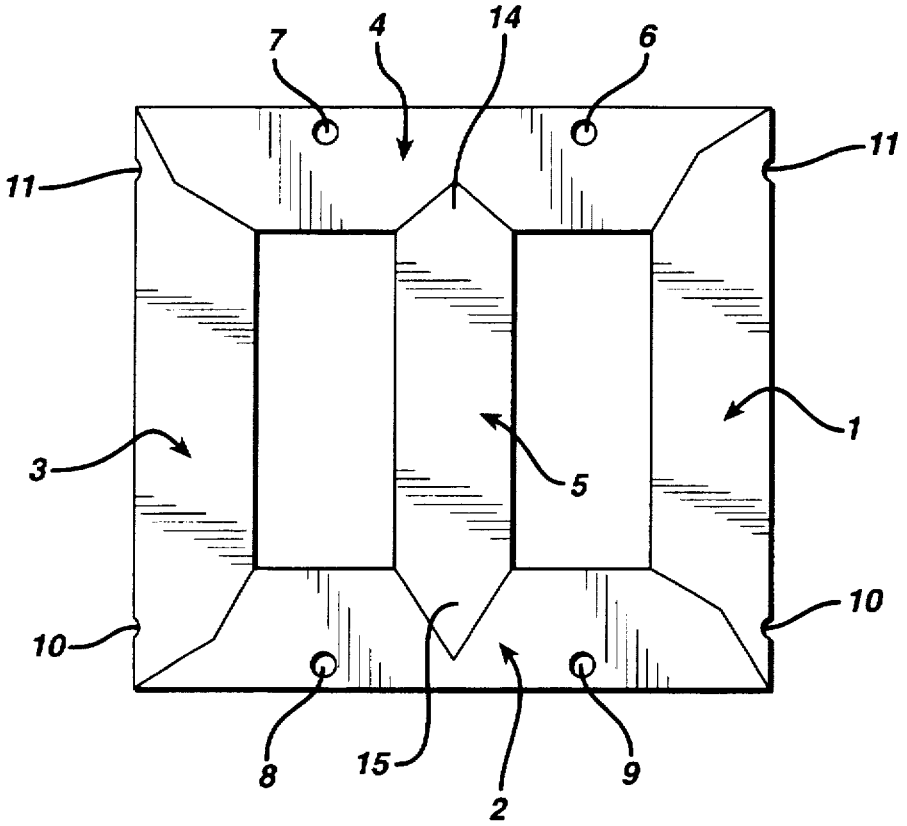
FIG. 1 is a plan view of a transformer core lamination assembly forming part of the present invention.

The transformer core of the present invention is of a configuration similar to the mitered butt lap core described in the aforementioned article by Lin and Zook. With reference to FIGS. 1 and 2A–2D, a core lamination assembly is shown comprising several legs. The lamination assembly includes legs 1 and 3 which are identical as shown in FIG. 2C. The other legs of the lamination include leg 4 shown in FIG. 2A, and leg 2 shown in FIG. 2D. The center leg 5 is shown in FIG. 2B.

Legs 1 and 3 (FIG. 2C) have notches 10 and 11 formed at one edge. The notches receive indexing pins on opposite faces of the lamination plates to provide a means for closing and locking in the gaps of the assembly. Clamping holes 6–7 and 8–9 are provided in legs 2 and 4. These clamping holes are located in the leg sections of the lamination of largest cross section and away from the gaps to prevent magnetic flux crowding which increases the local flux density.

Similarly, the center leg 5 of the core uses V joints 14 and 15 of different angles on opposite ends.

To reduce the magnetic path reluctance, the miter joints of each leg are increased in length and have asymmetrical angles at opposite sides of the lamination strip. This provides a more effective over lap by successive laminations. In all cases, the legs of the lamination are cut out so that all gaps have long length, presenting a larger cross sectional area, thereby reducing the flux density at the gaps.

Figure 2A:
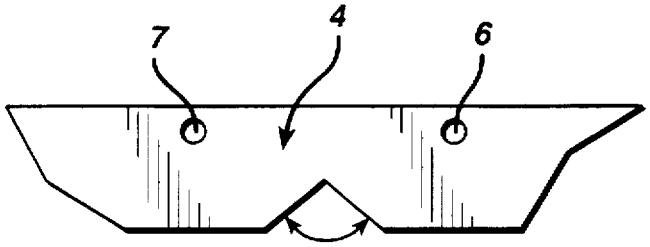
FIGS. 2A–2D are plan views of the parts of the transformer core lamination assembly shown in FIG. 1.
Figure 2B:
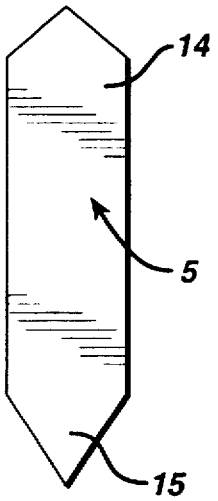
Figure 2C:
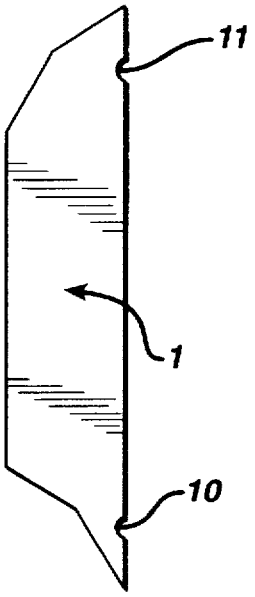
Figure 2D:
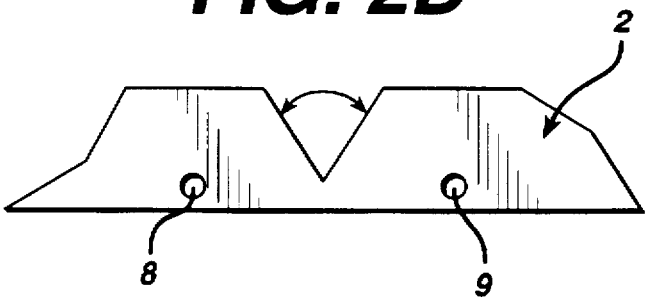
Figure 6:
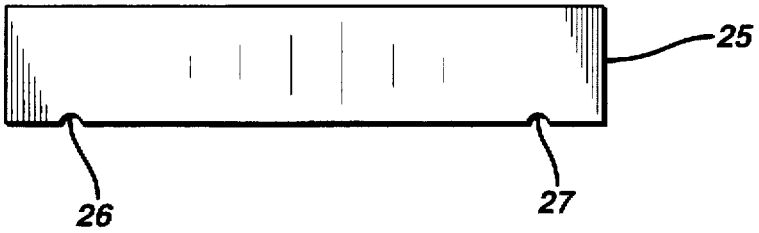
FIG. 6 is a top view of a spring used in the invention.
Figure 7:
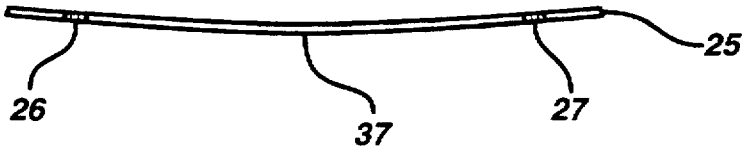
FIG. 7 is a side view of the spring shown in FIG. 6.
Figure 8:
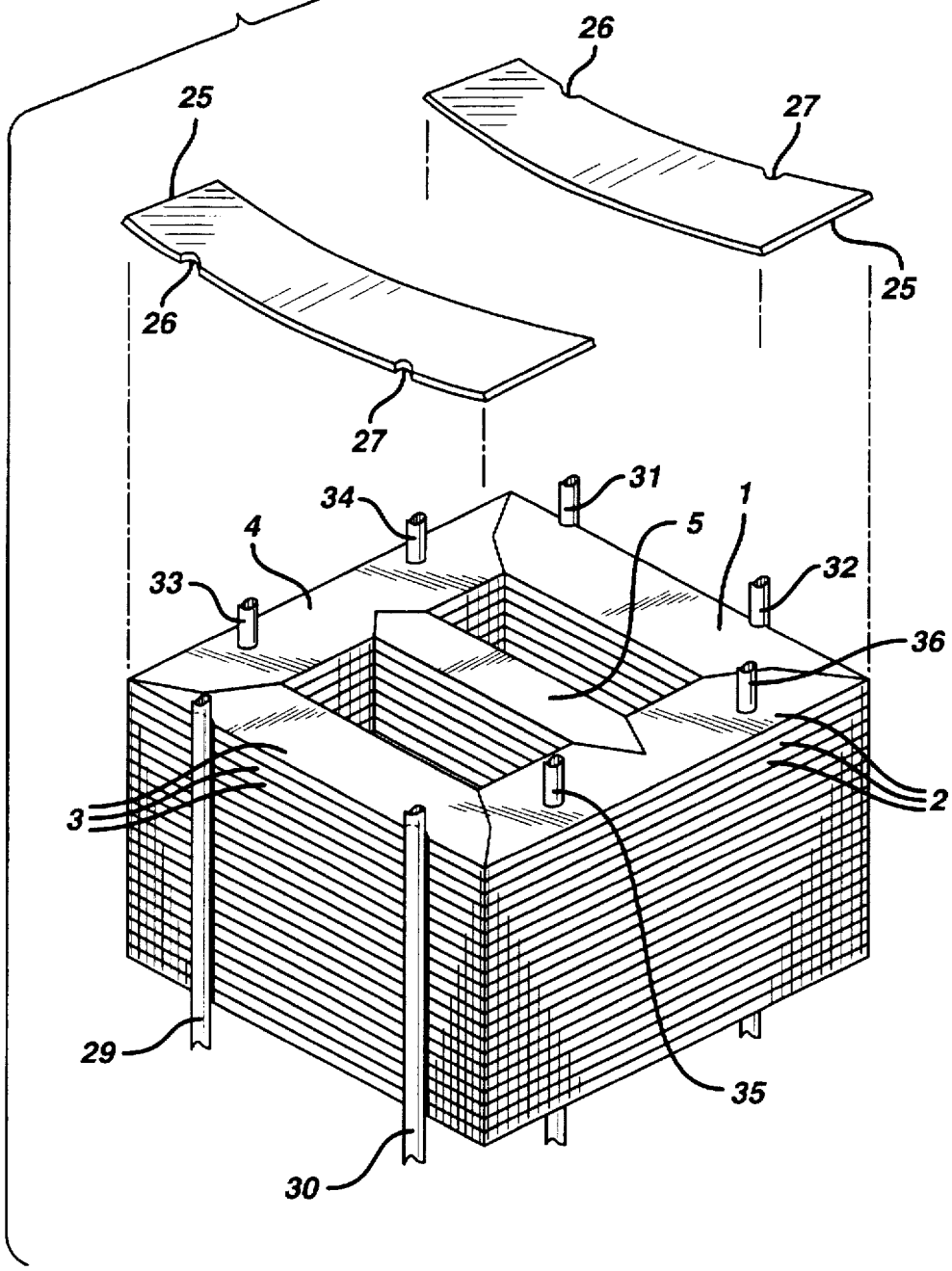
FIG. 8 is an assembly view of the invention.

Referring now to FIGS. 6–8, a stack of laminations shown in FIG. 1 is formed and secured by indexing pins 29–31 and by through bolts 33–36. The indexing pins engage the notches 10–11 in the lamination elements of FIG. 2C. The through bolts 33–36 are mounted in the holes 6–9 in the lamination elements of FIGS. 2A and 2D.

The stack is mechanically tuned by leaf springs 25 shown in detail in FIGS. 6–7. The leaf spring 25 is a rectangular steel plate which is bowed (at 37) centrally of the plate. Notices 2627 are formed in the outside edge of the spring 25. As shown in FIG. 8, two leaf springs 25 are mounted on the stack to engage the central portions of the lamination legs 1 and 3. The leaf springs 25 are partially held in place by indexing pins 29–32 which engage the notches 26 and 27.

Figure 3:
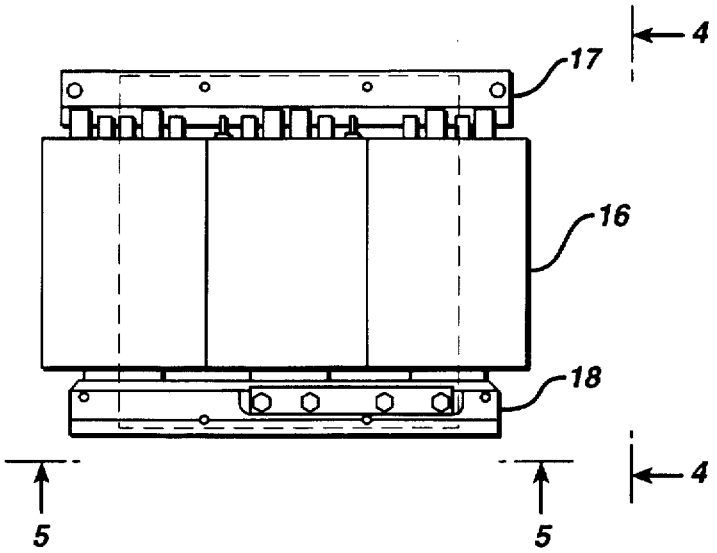
FIG. 3 is a side view of the mounting for a stack of laminations of the type shown in FIG. 1.
Figure 4:
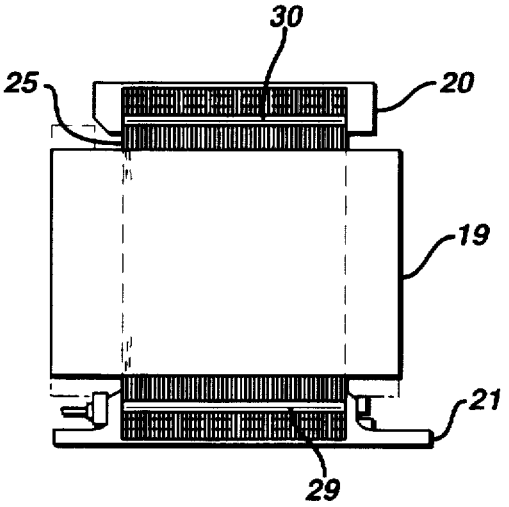
FIG. 4 is an end view of the apparatus of FIG. 3 taken along the line 4—4 of FIG. 3.
Figure 5:
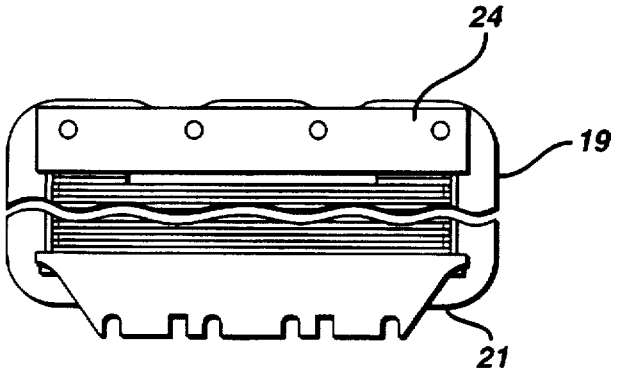
FIG. 5 is a bottom view of the apparatus of FIG. 3 taken along the line 5—5 of FIG. 3.

The stack is secured in the manner shown in FIGS. 3–5. With reference to FIGS. 4–5, the ends of the through bolts 33–36 and the ends of the indexing pins 29–32 are secured in mounting fixtures 20, 21 and 24. The mounting fixtures are thick steel plates. The leaf springs 25 are held against the central portion of the laminate elements by the mounting fixtures.

After the coil (not shown) is wound onto the stack, the assembly is impregnated with resin 19 and mounted in a suitable housing 16. Additional transport fixtures such as 17, 18 are secured to the housing for moving and positioning the transformer, as required.

While the invention has been described in its preferred embodiment, it is to be understood that the same is intended to be descriptive and not limiting and that changes may be made within the purview of the invention without departing from the true scope and spirit thereof.

We claim:

1. In a quiet transformer; a laminated core having each laminate formed as a flat layer from highly grain oriented silicon steel which is fabricated by laser cutting techniques; each of said layers including a plurality of segments in intimate contact with each other; each of said segments having mitered butt lap joints where each segment contacts the other for reducing the reluctance of the gaps between adjacent lamination segments, each of said mitered butt lap joints being increased in length and having asymmetrical angles at opposite ends of the lamination segment; said core including a center leg segment having V joints of different angles on opposite ends; each segment of said lamination being cut so that all gaps have long length thereby presenting a larger cross sectional area to reduce the flux density at the gaps; clamping holes formed in the element of said lamination having the largest cross section; said holes being formed at a location in said segment away from said gaps to prevent magnetic flux crowding and increased local flux density; indexing pins on opposite faces of said lamination segments for closing and locking in the gaps of said core assembly; each of said layers being 100% interleaved for producing low joint reluctance and to minimize magnetostrictive forces; said core being pressurized by clamping bracket means and bolts connected to opposite ends of said core; leaf spring means connected between said brackets and said laminations for applying pressure to portions of said laminations; and resin means covering said core for providing insulation and thermal enhancement for said core.

2. The transformer core of claim 1 wherein each layer of said core includes five legs, one of which is a central leg and the remainder of which legs are arranged in a square.

3. A laminated core for a quiet transformer comprising: a plurality of laminates, each laminate formed as a flat layer from highly grain oriented silicon steel; each of said laminates including a plurality of elements in intimate contact with each other; said elements having mitered butt lap joint means at the points of contact for reducing the reluctance of the gaps between adjacent elements; said mitered butt lap joint means having long lengths and asymmetrical angles at opposite ends each of said segments; said core including a center element having V joints of different angles on opposite ends thereof; each of said segments being cut so that all gaps have large cross sectional area for reducing the flux density at the gaps; clamping means formed in a segment of said lamination having the largest cross sectional area; said clamping means being formed at a location in said segment away from said gaps for preventing magnetic flux crowding and increasing local flux density; indexing pin fastening means attached to opposite faces of said laminations for closing and locking the gaps of said core; each of said laminations being 100% interleaved for producing low joint reluctance and for minimizing magnetostrictive forces; pressurized by clamping bracket means and bolt means connected to opposite ends of said core for pressurizing said core; spring means connected between said bracket means and said laminations for applying pressure to portions of said laminations; and resin means for covering said core for providing insulation and thermal enhancement for said core.

* * * * *